United States Patent [19]

Nablo

[11] 4,211,622

[45] Jul. 8, 1980

[54] PROCESS FOR IMPARTING DURABLE FLAME RETARDANCY TO FABRIC, FIBERS AND OTHER MATERIALS AND IMPROVED PRODUCT PRODUCED THEREBY

[75] Inventor: Sam V. Nablo, Lexington, Mass.

[73] Assignee: Energy Sciences Inc., Burlington, Mass.

[21] Appl. No.: 759,024

[22] Filed: Jan. 13, 1977

Related U.S. Application Data

[63] Continuation of Ser. No. 535,856, Dec. 23, 1974, abandoned.

[51] Int. Cl.[2] ..... C08L 3/00; C08L 5/00

[52] U.S. Cl. ..... 204/159.12; 8/116 P; 8/194; 8/DIG. 12; 204/159.15; 260/17.4 GC; 260/DIG. 24; 925/242

[58] Field of Search ..... 204/159.12, 159.15; 260/17.4 GC; 1/DIG. 24, 884, 857 G; 8/116 P, 194, DIG. 12

[56] References Cited

U.S. PATENT DOCUMENTS

| | | | |
|---|---|---|---|
| 3,083,118 | 3/1963 | Bridgeford | 117/47 |
| 3,188,165 | 6/1965 | Magat et al. | 8/115.5 |
| 3,962,054 | 6/1976 | Wattiez et al. | 204/159.12 |

*Primary Examiner*—Richard B. Turer

*Attorney, Agent, or Firm*—Rines and Rines, Shapiro & Shapiro

[57] ABSTRACT

A process is disclosed in which low energy electrons are used chemically to graft phosphorous or halogen-rich double bonded molecules and the like into natural and synthetic materials to render the same flame retarding.

6 Claims, No Drawings

PROCESS FOR IMPARTING DURABLE FLAME RETARDANCY TO FABRIC, FIBERS AND OTHER MATERIALS AND IMPROVED PRODUCT PRODUCED THEREBY

This is a continuation of application Ser. No. 535,856, filed Dec. 23, 1974, now abandoned.

The present invention relates to processes involving the use of additives for rendering fire-retarding, fabrics, fibers and other materials, including wood and other man-made and synthetic otherwise flammable materials; being more particularly directed to the discovery of the effect of relatively low energy electron radiation in effecting novel chemical grafting and surface coating bonding of such additives to the materials to provide greatly improved, long-lasting fire-resisting properties to the materials, and by simpler and more efficient processes, as well.

For some time, flame retardancy has been imparted to, for example, fabric materials through the chemical grafting of phosphorous or bromine-rich additives or the like to the fiber molecules; e.g. cotton or cellulose. Techniques for achieving this by chemical processes are described, for example, in "A New Durable Flame Retardant Finish For Cellulosics", Eisenberg et al, 1974 National Technical Conference, American Association of Textile Chemists and Colorists, New Orleans (Persulphate cure-catalysing vinyl phosphonate oligomer). Fibers other than the natrual cellulosics have, however, been more difficult to handle. As a consequence, the high intrinsic flammability of most of the synthetics, such as polyesters, polyurethanes or nylon, have made them unsuitable for many garment or bedding applications. The process underlying the present invention is directed, in an important application, to solving this problem . . . in particular, though not exclusively, for the polyester-cotton blends and pure polyesters which are used widely in children's clothing and sleepwear, as well as for mattress and bedspread fillers and covers and the like. The process utilizes the direct electron-radiation grafting of the flame retardant additive into the base textile fiber or into any material for which flame retardation or flame repellency is desired.

An object of the invention, accordingly, is to provide a novel process of rendering materials fire-retardant, differing radically from conventional chemical processes, and through the use of relatively low electron beam energy grafting to the materials—a process that causes a radiation-induced chemical bonding and surface coating curing of the fire-retardant additive to the material fibers or other structure involving a physical and chemical change and a bonded product that is clearly different from those achieved by normal chemically induced fire-retardant grafting using conventional peroxide or persulfate catalyzed processes.

A further object is to provide a new and improved fire-retarding grafted product.

Other and further objects will be explained hereinafter and are more fully delineated in the appended claims.

In summary, from one of its aspects, the invention embraces a process for grafting fire-retarding additives including phosphorous and halogen-rich compounds to fabrics, fibers and other flammable materials, that comprises, applying to the material a solution of the additive and a grafting compound for effecting copolymerization with the additive; adjusting the solids content of the applied solution to correspond to a predetermined desired add-on level; at least partly drying the material; exposing the material to an electron irradiating beam; and adjusting the electron irradiation within energy ranges of substantially 50 to 250 keV and levels of from substantially 2 to 5 megarads.

Preferred apparatus that may be adjusted in accordance with the present invention for use in carrying out the process of this invention, is described, for example, in U.S. Pat. Nos. 3,702,412; 3,745,396; and 3,769,600; involving a linear fan of energetic electrons accelerated through an electron-pervious window substantially normally upon the materials to be treated, which, in turn, may be carried longitudinally past the window. While the relatively low energy radiation used is preferably in such linear fan or curtain configuration for purposes of uniformity and simplicity, the invention may be practiced with other electron beams of similar energies and doses which may be appropriately moved or scanned, or a plurality of contiguous beams may be used to provide lateral extension along the material being passed through the treatment region. Advantages of the preferred techniques above-mentioned, as in the Electrocurtain TM apparatus of the assignee herein, Energy Sciences, Inc., of Burlington, Mass., are described also, for example, in Nablo, S.V. et al., "Electron Beam Process Technology", *Nonpolluting Coatings and Coating Processes,* 179–193, ed. J. L. Gordon and J. W. Prane, Plenum Press, New York, 1972.

It is perhaps most conducive to ready explanation of the invention, to describe the startling results of the invention by way of typical successfully operated experiments and processes and the products produced thereby, no drawings being deemed necessary to provide such teaching.

A vinyl phosphonate flame retardant, containing 22.5% phosphorous by weight or 7 phosphorous atoms per molecule (Stauffer Chemical Company Fyrol 76) was topically applied to a variety of decorative materials, such as structural urethane foams, tufted terry cotton fabrics, etc. These samples were dipped in a solution of 47% of the vinyl phosphonate, 43% $H_2O$ and 3% N-methylolacrylamide (60% solution) (N-MA) by weight, and then padded so that approximately 125% net weight gain occurred. The Fyrol 76 additive provides the phosphorous necessary for flame retardancy, while the N-MA offers a means of achieving an acceptable level of graft efficiency; it being believed that the N-MA grafts readily to cotton or similar fibers during copolymerization with Fyrol 76, with little if any actual grafting of the latter, to the fibers. These materials, in various stages of dryness involving different amounts of included water, were then treated at a dose of about 4 megarads, at line speeds of 7–50 meters per minutes in a strip type Electrocurtain TM processor, above described, with electron energies of from 100–175 keV. Subsequent measurements revealed that with solid weight gains in these materials of from 15–40%, the samples were either flame retardant (as defined by the pertinent standard AATCC vertical flame tests) at the lower end (15–25%), or flame repellent at the upper end (25–40%). Excellent durability resulted, as demonstrated by resistance of the samples so treated to washing, drying, bleaching and trichlor treatment.

To pass just the Dept. of Commerce FF3-71 3-second flame tests, weight gains of about 10–15% were found necessary with non-comparable proportions of the vinyl phosphonate and the N-MA. For example, with a solution of about 54% Fyrol 76, 43% water and 3% N-MA (60% water solution, applied to mercerized cotton, and irradiated as above described at 175 keV with about 2 to 5 megarads dose, just partial ignition occurred with a 10% weight gain, with no ignition for a 22% weight gain. Irradiation in a partially dried and various degrees of "wet" state was effected, with the finding that small reductions in the water content of the solution appear to produce some increases in the grafting efficiency. This suggests that at least a moderate pre-dry, prior to irradiation, is desirable in many circumstances to reduce the necessary irradiation level.

The use of the low energy electron radiation of the invention to effect grafting appears, moreover, to have advantages over chemically catalyzed (e.g. potassium persulphate) curing, in that less yellowing and physical degradation seems to take place.

With actual ratios of 19/21/60 for jersey, 50/10/40 for terry, of Fyrol 76/NMA (60%)/water, irradiation-treated samples of 3 to 5 oz/yd$^3$ cotton jersey knit and 5¾ oz/yd$^2$ cotton terry knit have easily passed the DOC FF 3-71 flammability test after 50 laundering cycles; this being the standard currently enforced on fabrics used in children's sleepwear. other products treated include a 50/50 polyester-cotton jersey knit, polyester/-nylon and 100% polyester quilted bedding materials, and a polyester/cellulosic nonwoven with a latex-acrylic binder.

In the above tests, in general, the samples of the knit or fabric to be treated are dipped in a water solution of approximately equal parts of Fyrol 76 and 60% N-MA dissolved in water. Additional water is added to adjust the solids content for whatever add-on level is desired. About 0.5% of Rohm and Haas Triton X-100 wetting agent is also preferably added. Saturated samples are hung up to dry under ambient conditions, then attached to masonite boards or webs and irradiated. Typical curing conditions for a treated knit (5½ oz/yd$^2$) are 5 Mr at 195 kV, in air. The sample is washed, dried and reweighed. The difference between the treated weight and initial weight shows the amount of Fyrol/N-MA attached to the fabric. Portions of the treated fabric are exposed to a flame to see if the material was flammable. If a suitable degree of flame repellancy was demonstrated, such samples were usually sent to a textile processor for additional laundering and flammability testing according to DOC FF 3-71.

In the development of this process, it was sought to achieve two goals:

(1) to produce fabrics with a good flammability rating; and (2) to achieve high graft efficiency of the fire-retardant components during irradiation while minimizing the physical degradation of the natural or synthetic fibers subjected to treatment.

The following variables were found necessary to be considered:

(1) the ratio of Fyrol 76 to N-MA or other similar compounds in the pad bath;

(2) the percentage of moisture or water in the treated fabric during irradiation;

(3) the total radiation dose (megarads), electron energy or penetration (kV), backscatter or reflection, elevated vs. room temperature treatment, and $N_2$ blanketing vs. air; and (4) the substrate material.

With regard to the formulation ratios or proportions, experiments showed that much higher graft efficiencies were obtainable as the proportion of N-MA increased relative to Fyrol 76, all with a highly acceptable hand and feel. One should keep in mind, however, that as the percentage of N-MA is increased, the treated fabric does become more harsh and at some point is unacceptable to the consumer. In addition, it is known that addition of such cross-linking agents reduces the tensile strength of cotton and the like fibers.

Turning to the degree of drying or wetness, in early experiments, samples were irradiated after drying for several hours at room temperature. Little attempt was made to define drying conditions, but it was assumed that samples should be slightly moist or damp during irradiation; the idea being that a small amount of water present would increase the mobility of both monomer and radicals, and, hence, increase the polymerization/-graft efficiency. Furthermore, an excess of water will lead to excess radical quenching and decreased grafting efficiency.

In one experiment, some quantitative data was obtained showing that graft efficiency (using a 62.5/6/47 solution) was only 18% when the sample was irradiated at 24% water content; whereas 64% graft efficiency resulted at 3.2% water content. A comprehensive experiment showed that the removal of all water (even residual fiber moisture) from the samples gave the overall best graft efficiency. Under the same processing conditions (with two different formulations), 8–10% higher graft efficiencies were obtained when samples were dried in a dessicator to very low moisture levels than when samples were only dried under ambient humidity conditions.

In view of the unexpected nature of these results, an examination was made of the dose necessary to cure films of Fyrol 76/N-MA containing various amounts of water. Under a nitrogen blanket, a thin layer of 100% Fyrol 76 on a steel plate required 4–5 Mr to cure to a soft film. By adding a 60% N-MA (in water) solution such that the total water content with Fyrol 76 is 6.7% (Fyrol/N-MA is 47/3.6), a soft film was obtained with only 1 Mr. The water content was further increased, keeping the proportions of Fyrol 76 to N-MA the same, to 13.4%, 25%, and even 35%. Soft films could be made with all these solutions, with the necessary dose increasing as the amount of water increased, so that at 35% water, the film needed 4–5 Mr to cure. From this study, it was concluded that the amount of water present during irradiation had much less of an effect on the copolymerization (not necessarily graft) than was previously thought.

Considering, now, the irradiation conditions, the early experiments varied the radiation dose over wide limits in an effort to achieve high or at least acceptable retardant add-on levels (graft efficiency was not important in the early stages). Generally, though, dose levels ranged from 2 to 6 Mr and occasionally up to 10 Mr. For a series of 3–6 oz/yd$^2$ white cotton knit products that performed well under DOC FF3-71, a dose level of 5 Mr was applied consistently. There is evidence that 4 and even 3 Mr may be acceptable under some conditions, but less than 3 Mr seems significant to lower the graft efficiency. The 5 Mr, moreover, has been found consistently to produce good results with several different fabrics and formulations.

Voltages of from about 175–195 keV have been used in much of this work to assure good electron penetration and, hence, curing. In a quantitative experiment, it was found that for identical samples (treated cotton knit), irradiated at 150 kV vs. 195 kV (both 5.0 Mr), the graft efficiencies dropped about 15% at the lower voltage. It is deemed desirable that such fabrics be irradiated at a minimum of about 190 kV, though, as above explained, lower voltages can be used for lighter fabrics. What has been repeatedly demonstrated in this work is that electron energies much below the energy required for penetration of the average thickness of the material will provide efficacious grafting. For example in experiments on 5½ oz/yd$^2$ (21 mg/cm$^2$) flanellette made from 100% cotton, little decrease in grafting efficiency (<15%) was measured in reducing the electron energy from 150 keV to 115 keV. Since the effective range of the penetration of a 150 keV electron is 21 mg/cm$^2$ while that of a 115 keV electron is only 11 mg/cm$^2$, these tests deomonstrated that low energy electrons practically can be used for graft initiation in woven or knit materials with effective ranges of penetration considerably below the average thickness of the basic substrate fabric. This range "extension" results from the effects of multiple electron scattering between the fibers of the yarn used in manufacture of the material, so that deep penetration in the porous substrate results.

The use of a high atomic number reflecting surface showed some graft efficiency increase when placed behind the fabric treatment zone. In order to study the role of temperature on graft efficiency, some knit samples were heated at 220° F. for 2 minutes, placed on a pre-heated 225° F. panel support and then irradiated; being compared to samples heated at 225° F. for 2 minutes, but allowed to cool and then irradiated on room temperature panels. There was little difference (0.6% in weight gain) between the samples, illustrating that temperature played little role in the grafting process. This parameter is important as it precludes the need for cooling of the web after drying, prior to introduction to the electron processor. These tests also revealed that treatment at elevated temperature eliminated the yellowing produced in cotton immediately after irradiation.

Turning to the medium of irradiation ($N_2$ or air), while there is some evidence that $N_2$ curing may be beneficial in avoiding any inhibition by oxygen of the copolymerization or graft reaction, highly successful results have been consistently attained through air without the necessity for a $N_2$ blanket. This ability to graft under ambient conditions is most desirable from the industrial application viewpoint.

As for the substrate materials, many experiments have concentrated on cotton terry and jersey knits in an attempt to develop a process that can be used by children's sleep-wear manufacturers. Cotton terry (nylon backed) treated as above, has passed the DOC FF3-71 flammability test after 50 washings; and many subsequent samples have also passed, using various weight jersey and terry knits, different fire-retardant formulations, and different add-on levels.

Treated 100% polyester and nylon 6/polyester have passed other flammability tests when treated in accordance with the invention.

In all cases, the electron irradiation grafting is believed to produce a different physical and chemical bonding and treatment to the fibers than with conventional chemical polymerization processes before discussed, accounting for the improved results of the invention, and even with fabrics and materials that have not heretofore been successfully rendered fire-retarding, as previously described. As another example of this, prior chemical processes use chelating agents in the pad bath to scavenge metal ions that might accelerate polymerization. With the present invention, there is no need for such agents since no catalyst is involved in the solution to initiate polymerization in the irradiation grafting process of the invention.

While it is not desired to predicate the invention on any particular theories or to be bound thereby, it being sufficient to describe the precise steps that are found to produce the novel results as herein presented, it may be helpful to an understanding of the mechanisms involved to offer a theoretical belief as to the operation. In the first place, when cellulose or similar molecules are electron-irradiated, their structure becomes changed to produce free radicals not existing in the unirradiated cellulose molecules that have heretofore been subjected to pure chemical catalysed grafting as of the potassium persulphate type described in the before-cited Eisenberg et al paper. Thus, the locations of free radicals in the fiber molecules to which the fire-retardant additive may be bonded by the irradiation treatment herein are different from those existing in the unirradiated fiber molecules. (Such irradiation-produced free-radical locations in the cellulose molecule rings are discussed, for example, by Gaughran et al, "Sterilization by Ionizing Radiation", p. 400–1, Multi Science Publication Ltd., Montreal, Canada, 1974). The electron-grafting of the additive, therefore, produces a different chemical and physical arrangement than the purely chemically cured catalyst bonding, providing a different end product that, as before explained, has vastly improved properties.

The critical low-energy electrons used in accordance with the discoveries underlying the invention should be contrasted, moreover, from prior electron-grafting techniques, mainly for other purposes than fire-retarding applications such as, for example, the formation of desalination membranes of styrene grafted to cellulose acetate as described by Hoppenberg et al, "Novel Membranes Prepared By Radiation Grafting of Styrene to Cellulose Acetate", 157th National ACS Meeting, Division of Cellulose, Wood and Fiber Chemistry, Minneapolis, Apr. 14–18, 1969. In such entirely different applications, where changing of the properties of the substrate is not of concern, and certainly not to any degree comparable to that required in providing substantially the very same fabric appearance, performance and color, for example, before and after treatment, very high energy radiation is used which would forbid the practice of the present invention or the solution of its different problem. Energies of, for example, 1.1–1.3 MeV of penetrating gamma rays from Cobalt 60 and other sources of the same energy level, are involved in such different processes; and, in the membrane application above-cited, low dose rates of about 100 rads/second. Other examples of the similar use of such high energies from Cobalt 60 and related gamma ray sources for entirely different copolymer grafting applications are described in U.S. Pat. Nos. 3,115,418; 3,131,138; 3,201,336; 3,252,800; 3,298,942; 3,433,724; and 3,711,389. In the case of the last-named patent, an actual fire-retardant application is involved; but its application, unlike that of the present invention, permits the use of the high energy cobalt 60 (1.1–1.3 MeV) and comparable high voltage electron accelerators to graft unsaturated phosphazenes to synthetic and natural polymeric materials, apparently under conditions where the inherently resulting changes in such materials are not undesirable, as they are in the circumstances of the present invention.

As still additional evidence of the very different resulting products of the invention, the following table contrasts the considerably different properties attained with Fyrol 76 flame retardant bonded to 3½ oz/yd$^2$ cotton flannelette when electron-irradiated as described above, and when chemically bonded with the persulphate catalysbic curing previously described. This table moreover, shows considerably less change from the untreated flannelette with the process of the invention:

| | Stitch Tear (Pin Test) lbs. | Grab Tensile (Warp); lbs. | Grab Tensile (filling); lbs. | Water Absorbency (Wet Pick-up 15 minutes), % |
|---|---|---|---|---|
| Untreated | 5 | 81 | 87 | 559 |
| Persulphate Process | 2 | 59 | 38 | 391 |
| Electron-Irradiation Process of Invention | 3 | 72 | 69 | 465 |

Add-ons for both processes were approximately the same (28–30%).

Further modifications will also occur to those skilled in this art, and all such are considered to fall within the spirit and scope of the invention as defined in the appended claims.

What is claimed is:

1. A process for grafting a fire-retarding additive selected from the group consisting or phosphorus-rich and halogen-rich fire-retarding compounds to a flammable fibrous fabric selected from the group consisting of nylon, polyester, and cellulosic materials, that comprises, applying to the fabric a solution of the additive and an effective amount of a copolymerization-grafting compound for effecting copolymerization with the additive, with the solids content of the solution selected to correspond to a predetermined desired add-on level within the range of substantially 15–40% by weight, at least partly drying the fabric by evaporating moisture therefrom to improve the graft efficiency, irradiating the fabric, so treated, with an electron curtain beam substantially perpendicular to the fabric for uniformity of irradiation, with the energy of the beam adjusted to an energy level within the range of substantially 50–250 keV and considerably below the energy required for the electrons of the beam to penetrate the average thickness of the material constituting the fabric, scattering the electrons of the beam between the fabric fibers to extend the effective range of electron penetration, moving the fabric past the beam at a speed within the range of about 7–50 meters per minute, and adjusting the dose of the electron beam radiation delivered to the fabric to a level within the range of substantially 2–5 megarads.

2. A process as claimed in claim 1 and in which the solution is a water solution.

3. A process as claimed in claim 2 and in which the additive comprises a vinyl phosphonate and the copolymerization-grafting compound comprises an acrylamide.

4. A process as claimed in claim 1 and in which the proportions of the additive and the copolymerization-grafting compound are comparable.

5. A process as claimed in claim 1 and in which the fabric is irradiated while at a temperature elevated above room temperature.

6. A process as claimed in claim 1 and in which the fabric is irradiated while in an air environment.

* * * * *